US008327739B2

(12) United States Patent
Kubota

(10) Patent No.: US 8,327,739 B2
(45) Date of Patent: Dec. 11, 2012

(54) WHEEL NUT WRENCH AND MANUFACTURING PROCESS THEREOF

(75) Inventor: Tatsuo Kubota, Saitama Prefecture (JP)

(73) Assignee: Rikenseiko Co., Ltd., Saitama Prefecture (JP)

( * ) Notice: Subject to any disclaimer, the term of this patent is extended or adjusted under 35 U.S.C. 154(b) by 287 days.

(21) Appl. No.: 12/640,169

(22) Filed: Dec. 17, 2009

(65) Prior Publication Data

US 2011/0005356 A1 Jan. 13, 2011

(30) Foreign Application Priority Data

Jul. 8, 2009 (JP) ..... 2009-162246

(51) Int. Cl.
*B25B 13/06* (2006.01)

(52) U.S. Cl. ..... 81/121.1; 81/124.7

(58) Field of Classification Search ..... 81/121.1, 81/119, 124.4–124.7, 177.5–177.7, 185; 7/100

See application file for complete search history.

(56) References Cited

U.S. PATENT DOCUMENTS 3,161,093 A * 12/1964 Hoag ..... 81/177.6
3,916,736 A * 11/1975 Clemens ..... 81/185
4,817,334 A * 4/1989 Badger et al. ..... 49/55
7,334,506 B2 * 2/2008 Hui ..... 81/124.4
7,841,261 B2 * 11/2010 Milligan et al. ..... 81/121.1

* cited by examiner

*Primary Examiner* — Hadi Shakeri
(74) *Attorney, Agent, or Firm* — Notaro, Michalos & Zaccaria P.C.

(57) ABSTRACT

In order to provide a wheel nut wrench in which strength of a nut socket portion is allowed to be increased even though processes are facilitated under a situation where a tube made of carbon steel such as S45C is used as a material, and a manufacturing process thereof, an embodiment to implement the present invention is a wheel nut wrench made with a tube-shaped steel tube and provided with a nut socket portion at least one end, a nut socket shell portion whose inner and outer peripheries are both formed in a hexagonal shape is provided at an end portion of the steel tube, a sleeve made of a steel plate and having a cross section of a hexagonal shape is pressed into the nut socket shell portion, and a portion of the nut socket shell portion is deformed toward the sleeve to thereby achieve unification of the nut socket portion and the sleeve.

14 Claims, 13 Drawing Sheets

17
F
25
16
18
15

16
15
E 16
16a
16b
16a
15
2a
G
19

WHEEL NUT WRENCH AND MANUFACTURING PROCESS THEREOF

FIELD OF THE INVENTION

The present invention relates to a wheel nut wrench suitable to be used for attaching/detaching wheels of a vehicle, and a manufacturing process thereof.

BACKGROUND ART

As for a wheel nut wrench, there are various types of wheel nut wrenches such as an open-ended type, a single-ended T shape, and a single-ended L shape. Among them, the single-ended L-shaped wheel nut wrench is constituted in a manner that a round bar (an inner filling body) made of carbon steel is used in general, a nut socket portion is formed at a tip thereof by hot forging, and then a side where this nut socket portion is provided is bent to an L shape. Among various types of wrenches such as this single-ended L-shaped wheel nut wrench, there is one sold as a single component, but most of them are each mounted in a vehicle as an accessory attached to the vehicle. Thus, the number of wrenches is enormous, and a significant cost reduction is required.

Thus, as for the single-ended L-shaped wheel nut wrench in particular, in contrast with a conventional wheel nut wrench made after a round bar is processed, a wheel nut wrench constituted in a manner that a nut socket portion is formed by cold forging with a tube made of carbon steel as a material, and a side where this nut socket portion is provided is bent to an L shape is well known in Japanese Patent Publication No. Hei 3-27297, Patent Document 1.

As for the conventionally well-known wheel nut wrench disclosed in above-described Patent Document 1, the material is a tube made of carbon steel of S45C, and furthermore the nut socket portion can be formed by cold forging, and therefore it makes it possible to reduce a manufacturing cost compared to the conventional wheel nut wrench with the round bar. However, in order to prevent that a thickness of the nut socket portion thins to thereby reduce strength, a process to make the nut socket portion thick is required, and it takes time for this process to be performed, so that a problem that a sufficient cost reduction cannot be achieved is caused.

The wheel nut wrench, in actual use, is used in such a way that a handle portion is hit with a hammer, a supporting tube is inserted into a handle portion, a foot or feet is/are put on a handle portion to apply a total body weight thereon, or the like, and thus, there is often a case that significant torsional pressure is applied on the nut socket portion.

Therefore, in the case when the single-ended L-shaped wheel nut wrench is manufactured with a tube, how deformation-resistant strength against torsional pressure on the nut socket portion is increased under a situation where processes are made as easy as possible is a next issue.

SUMMARY OF THE INVENTION

An object of the present invention is to provide a wheel nut wrench in which strength of a nut socket portion is allowed to be increased even though a tube made of carbon steel is used as a material and processes are facilitated, and a manufacturing process thereof.

In order to achieve the above-described issue, the present invention is characterized in that it is a wheel nut wrench made with a tube-shaped steel tube and provided with a nut socket portion at least one end, and in which a nut socket shell portion whose inner and outer peripheries are both formed in a hexagonal shape is provided with at an end portion of the steel tube, a sleeve made of a steel plate and having a cross section of a hexagonal shape is pressed into the nut socket shell portion, and a portion of the nut socket shell portion is deformed toward the sleeve to thereby achieve unification of the nut socket portion and the sleeve.

In the present invention at this time, it is possible to constitute a shape of the nut socket portion in a manner that inner and outer peripheries thereof are both expanded to have a hexagonal shape.

In the present invention, it is further possible to constitute the sleeve in a manner that a belt-shaped steel plate is bent to have a cross section of a hexagonal shape.

In the present invention, it is further possible to constitute the sleeve in a manner that in a shape thereof, inner and outer peripheries both are the same in thickness to have a hexagonal shape, and a joint portion is welded.

The present invention is further characterized in that a plurality of fixing holes are provided in a peripheral wall of the sleeve, and a peripheral wall of the nut socket shell portion is bulged to the fixing holes by punching in order to unify the nut socket shell portion and the sleeve.

In the present invention at this time, it is possible to provide the fixing holes in corner portions of the sleeve.

The present invention is further characterized in that the fixing hole is provided in a joint of the sleeve.

The present invention is further characterized in that a pierced hole having a size different at an entry thereof and an exit thereof is provided in a handle portion in a direction perpendicular to the handle portion.

Then, in the present invention, the wheel nut wrench is set as a single-ended L shape.

The present invention is further characterized in that a manufacturing process of a wheel nut wrench includes: using a tube-shaped steel tube; forming a nut socket shell portion having a cross section of a hexagonal shape at an end portion thereof by cold pressing; pressing a sleeve made by a belt-shaped steel plate being bent and having a cross section of a hexagonal shape into the nut socket shell portion; and unifying a nut socket portion with the sleeve by plastic deforming.

At this time, the present invention is characterized in that a shape of the nut socket shell potion is constituted in a manner that outer and inner peripheries thereof are both formed in a hexagonal shape.

The present invention is further characterized in that a heat treatment is performed for the sleeve.

The present invention is constituted as above, so that the following effects can be obtained.

A tube-shaped steel tube is used to form a handle portion, a bent portion, and a nut socket shell portion by cold pressing, and a sleeve that has a cross section of a hexagonal shape and is made of a steel plate similarly is pressed into the nut socket shell portion, and then a unification process is performed for the nut socket shell portion and the sleeve, and thereby unification of both the nut socket shell portion and the sleeve is achieved, resulting that a process of the nut socket shell portion becomes easy to be performed in particular. Consequently, it becomes possible to provide a wheel nut wrench in which a nut socket portion is strengthened by the sleeve under a situation where a tube-shaped steel tube allowed to be manufactured inexpensively is used, and a manufacturing process thereof.

DETAILED DESCRIPTION OF THE PREFERRED EMBODIMENT

Figure 1:
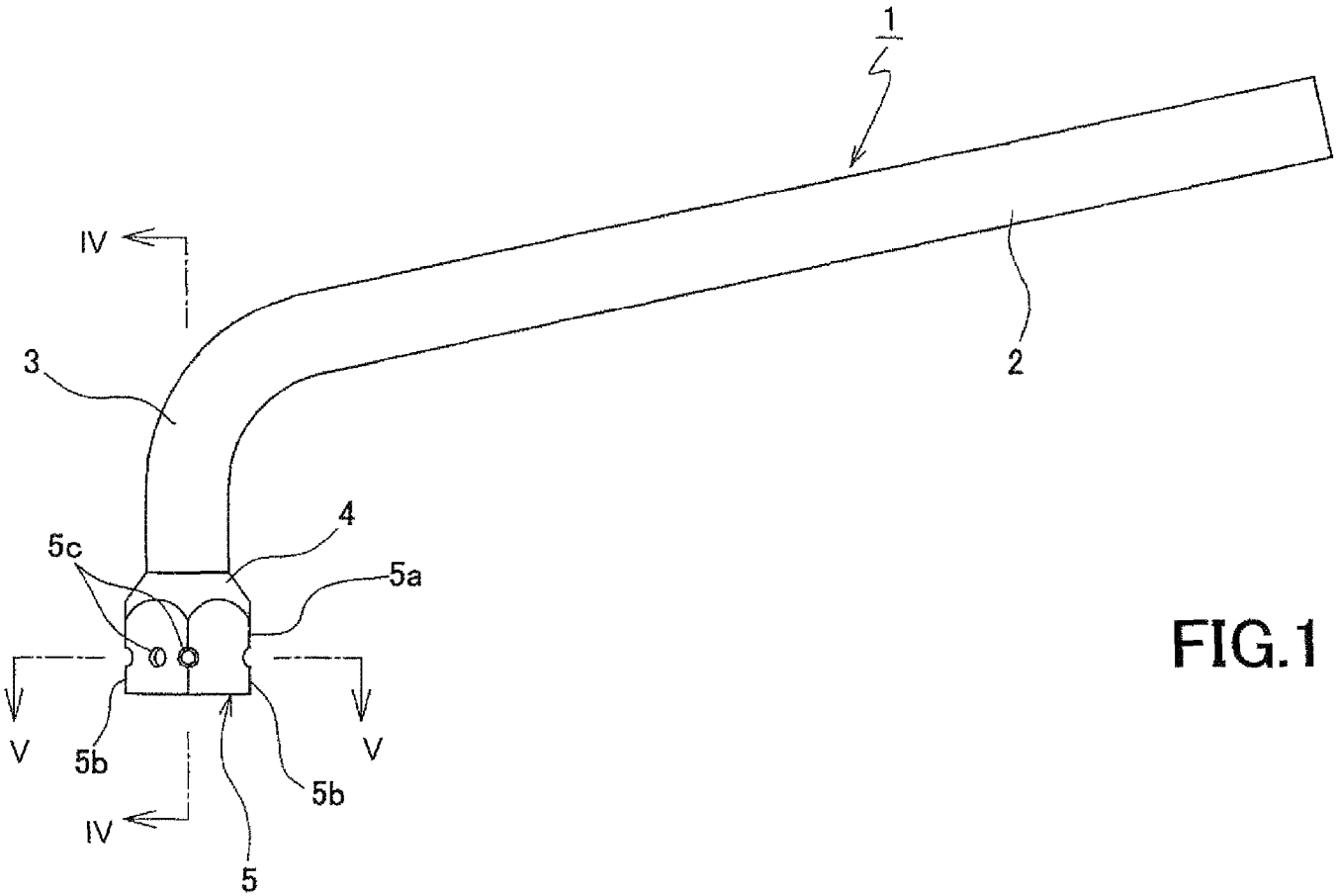
FIG. 1 is a front view of a wheel nut wrench according to the present invention.

An embodiment to implement the present invention is a wheel nut wrench made with a tube-shaped steel tube and provided with a nut socket portion at least one end, a nut socket shell portion whose inner and outer peripheries are both formed in a hexagonal shape is provided at an end portion of the steel tube, a sleeve made of a steel plate and having a cross section of a hexagonal shape is pressed into this nut socket shell portion, and a portion of the nut socket shell portion is deformed toward the sleeve to thereby achieve unification of the nut socket portion and the sleeve.

Hereinafter, an embodiment of the present invention will be explained in detail based on the drawings in the case when the present invention is applied to a single-ended L-shaped wheel nut wrench, but the present invention can also be applied to an open-ended type wheel nut wrench and a T-shaped wheel nut wrench as it is besides the above.

FIG. 1 to FIG. 6 show one embodiment of a wheel nut wrench 1 according to the present invention. According to the drawings, the wheel nut wrench 1 according this embodiment is a single-ended L-shaped wheel nut wrench, and is made of a tube-shaped carbon steel tube, (which is also called a steel tube in the present application), such as tube-shaped S45C, for example. This single-ended L-shaped wheel wrench 1 is constituted by a handle portion 2 having a pierced hole 2*a*, a bent portion 3 provided on one side end portion side of this handle portion 2, and a nut socket portion 5 tube-expanded via a head portion 4 provided at a tip of this bent portion 3, and the nut socket portion 5 is constituted by a nut socket shell portion 5*a* and a sleeve 7 inserted into and fixed to this nut socket shell portion. This single-ended L-shaped wheel nut wrench 1 is constituted by processing a tube-shaped material, and thus a communication hole 6 is formed through from the nut socket portion 5 to the handle portion 2. Further, in this single-ended L-shaped wheel nut wrench 1, a material thereof is a carbon steel tube as described above, but besides the above, stainless steel (SUS) or aluminum alloy can be used. The pierced hole 2*a* is formed in a manner that it is in a substantially elliptical shape and as for sizes on an entry 2*b* side and an exit 2*c* side, the entry 2*b* side is large and the exit 2*c* side is small. However, the present invention is not limited to the above.

Figure 2:
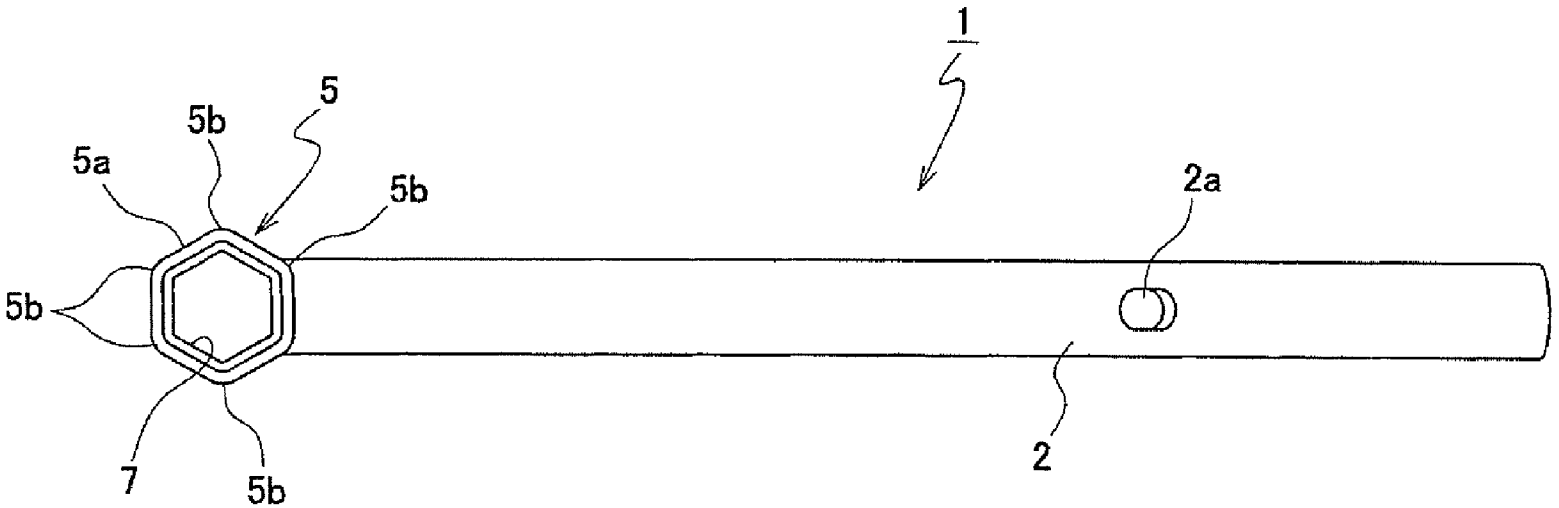
FIG. 2 is a bottom view of the wheel nut wrench shown in FIG. 1.
Figure 3:
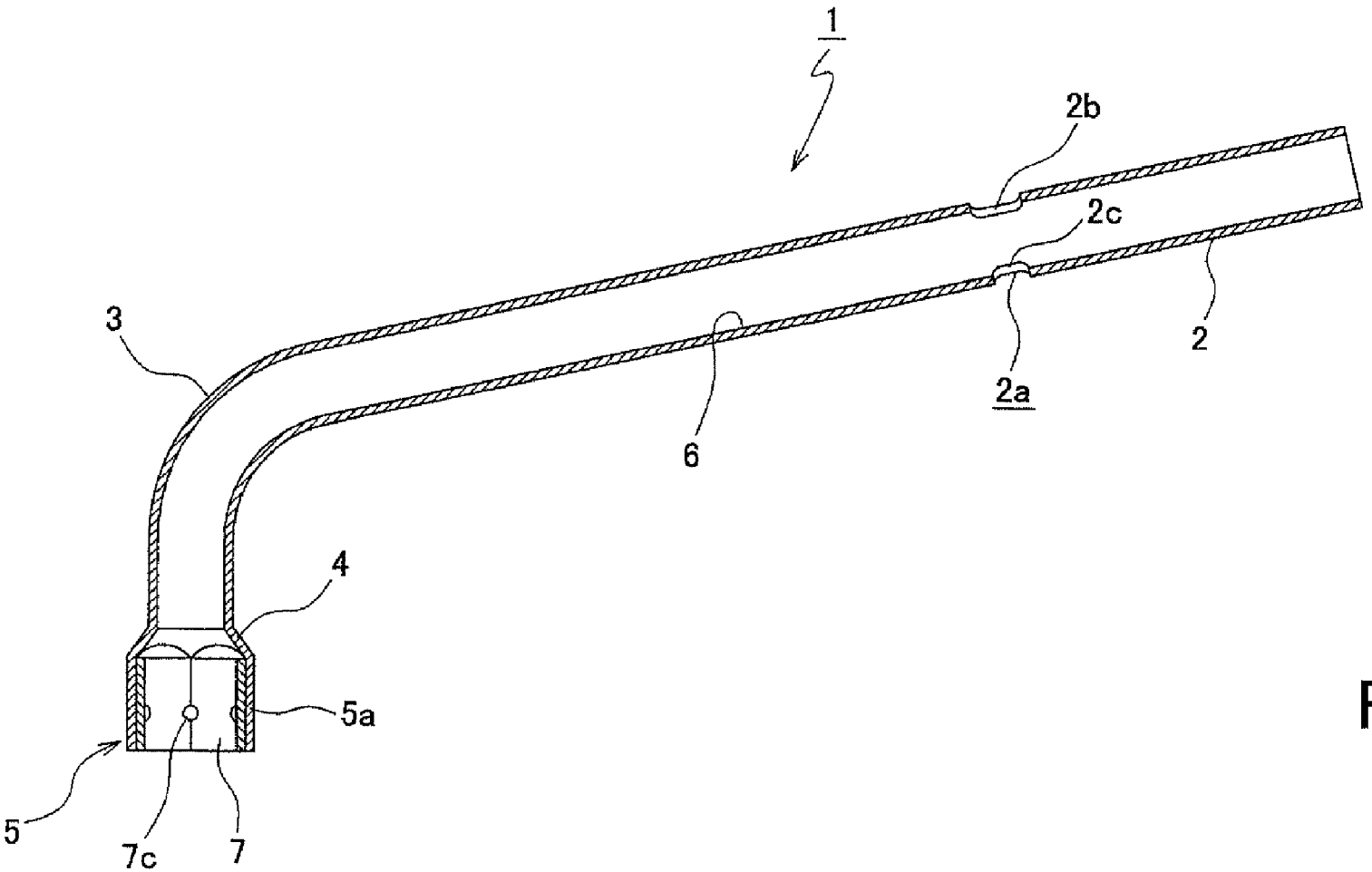
FIG. 3 is a vertical cross-sectional view of the wheel nut wrench according to the present invention.

As shown in FIG. 2 in particular, the handle portion 2, the bent portion 3, the head portion 4, and the nut socket shell portion 5*a* of the nut socket portion 5 are substantially uniform in thickness, and in particular, a thick portion is not formed. Thus, there is no need to form a thick portion by a tube shrinking process or an ironing process. Therefore, steps of a process are reduced and the process is facilitated, and a tube expanding deformation process can be performed without exerting unreasonable force on the steel tube.

As for a shape of the nut socket shell portion 5*a* as well, inner and outer peripheries both have a cross section of a hexagonal shape, in which a thickness between the inner and outer peripheries is substantially the same as those of other portions, and the sleeve 7 that has a cross section of a hexagonal shape and has the thickness same as that of the nut socket shell portion 5*a* similarly is pressed into and fixed to the inside. However, the nut socket shell portion 5*a* is tube-expanded from a tube diameter of the handle portion 2, and therefore, the thickness is slightly thinner than those of the other portions in the strict sense, but a thickness to be reduced is about 0.5 mm, and there is no significant difference from the other portions. However, since the sleeve 7 is inserted into and fixed to this nut socket shell portion 5*a*, as the nut socket portion 5, the total thickness is thicker than those of the handle portion 2, the bent portion 3, and the like besides the above.

Figure 6:
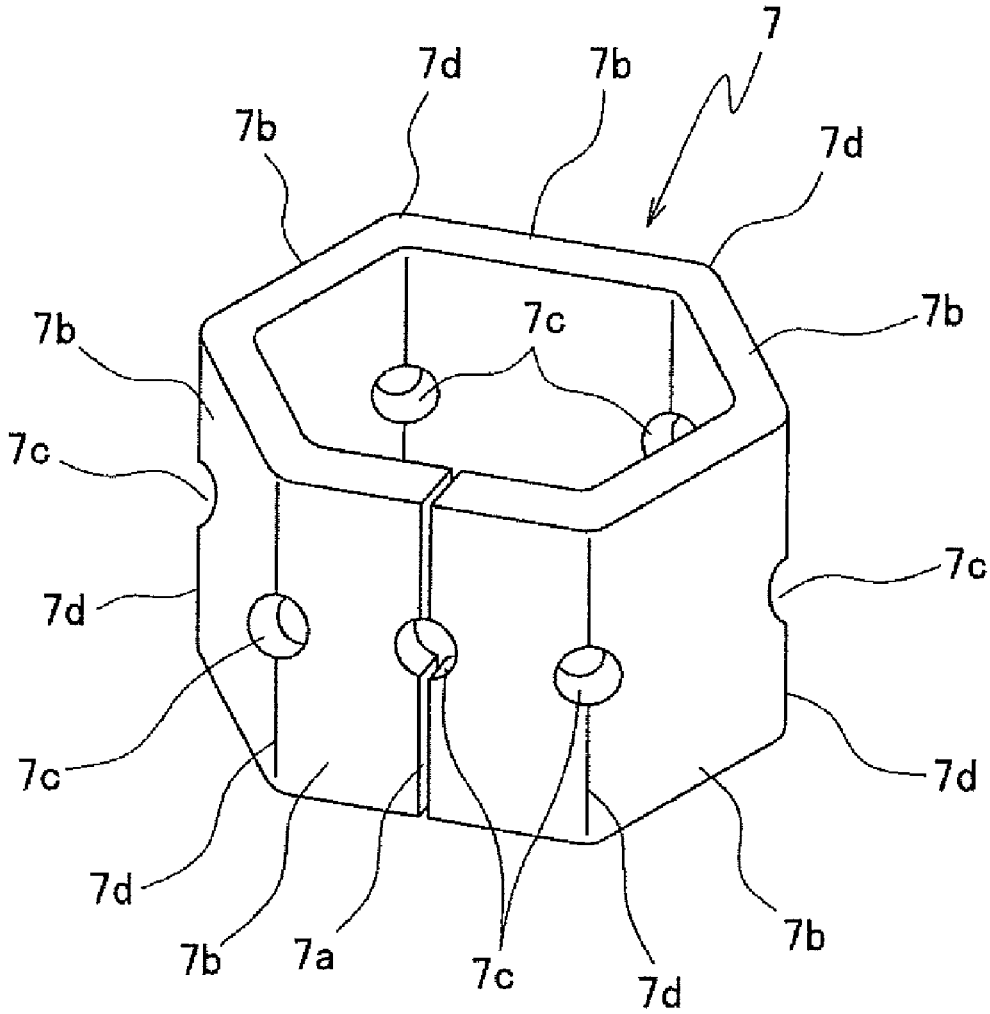
FIG. 6 is a perspective view of a sleeve in the wheel nut wrench according to the present invention.

This sleeve 7 is formed in a manner that a belt shaped carbon steel plate made of, for example, S45C, (which is also called a steel plate in the present application), is bent to have a cross section of a hexagonal shape, and as shown in FIG. 6 in particular, a joint 7*a* is formed in one of flat plate portions 7*b*. As for this joint 7*a*, a joint whose both ends 20, 21 are simply abutted and a joint whose both ends are welded together can be considered, and sufficient strength can be obtained by only abutting. A material for this sleeve 7 is also S45C in this embodiment, but stainless steel (SUS) can also be used.

Figure 4:
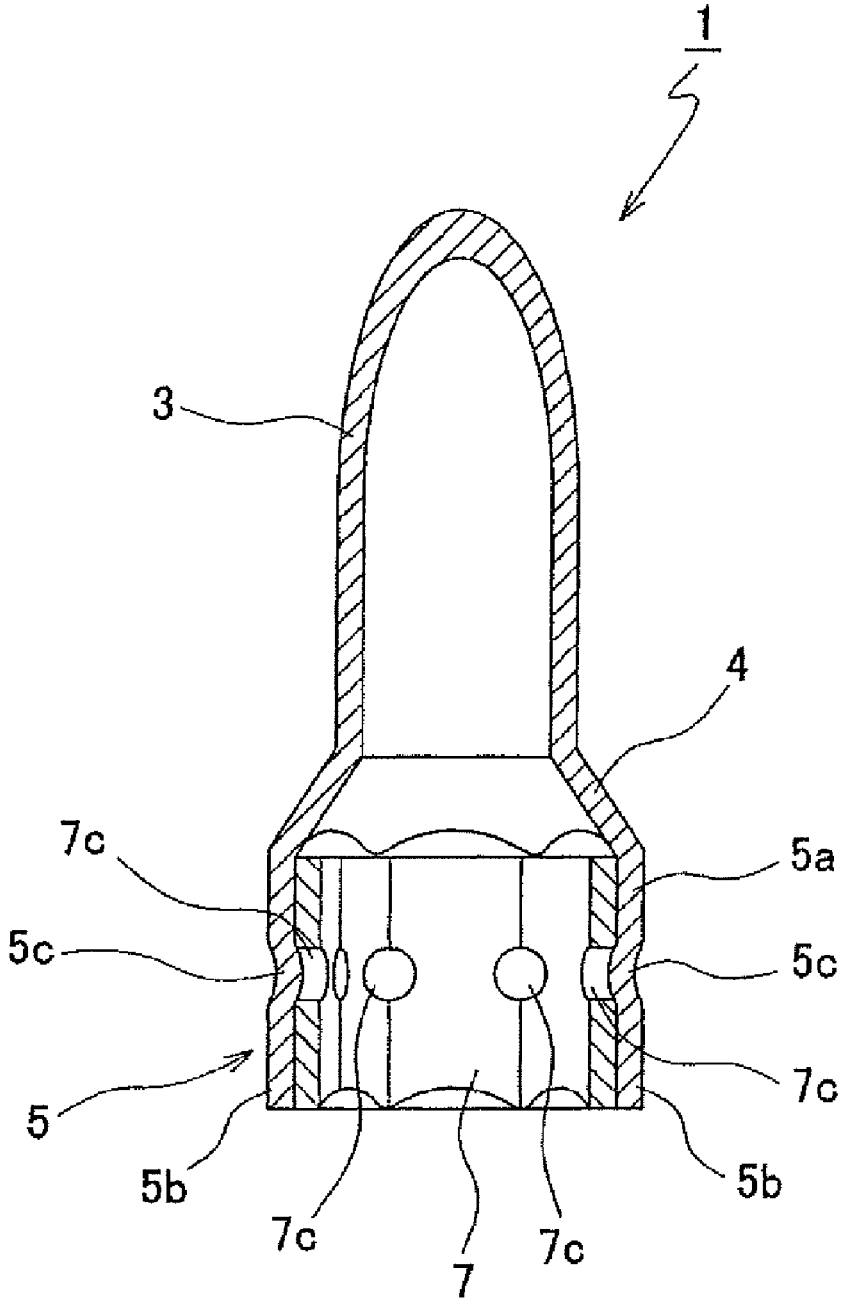
FIG. 4 is a cross sectional view of the wheel nut wrench according to the present invention when it is seen from a direction of an IV-IV line in FIG. 1.
Figure 5:
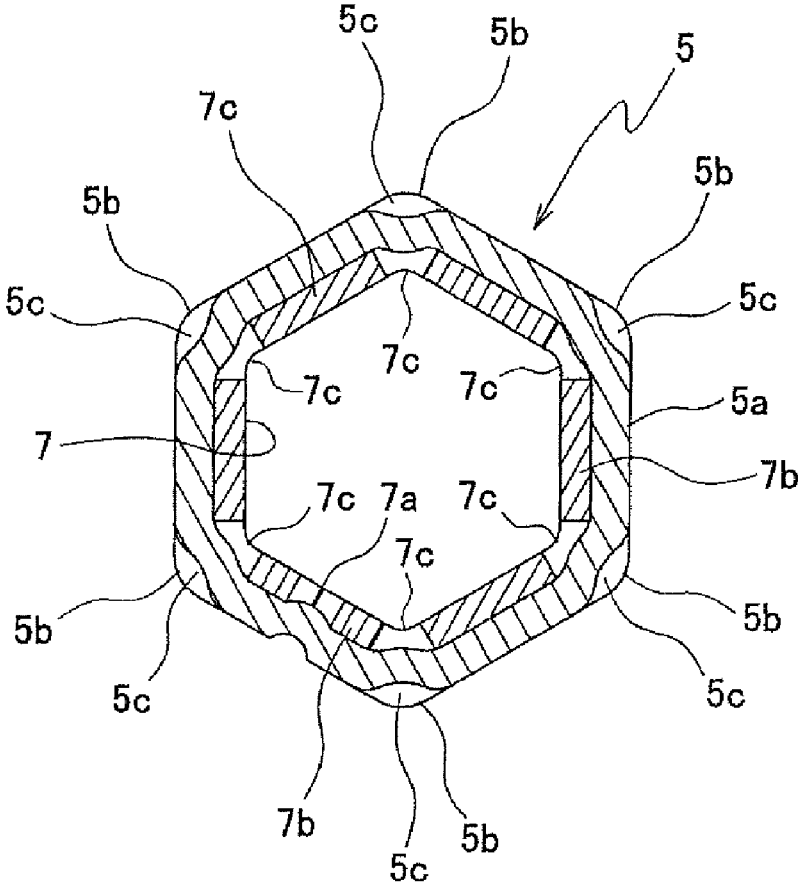
FIG. 5 is a cross sectional view of the wheel nut wrench according to the present invention when it is seen from a direction of a V-V line in FIG. 1.

Further, in respective comer portions 7*d* and one of the flat plate portions 7*d* of the sleeve 7, as shown in FIG. 5 and FIG. 6 in particular, fixing holes 7*c* are provided. As shown in FIG. 4, after the sleeve 7 is pressed into the nut socket shell portion 5*a*, a portion corresponding to each of corner portions 5*b* of the nut socket shell portion 5*a* and each of the fixing holes 7*c* of the flat plate portions 7*b* is punched from the outside by using a punch, and the inside of the nut socket shell portion 5*a* is bulged to the fixing holes 7*c* to be engaged to the fixing holes 7*c*, and thereby unification of the sleeve 7 and the nut socket shell portion 5*a* is achieved. In the drawing, concave portions made by punching, which may also be referred to as fixing protuberances, are denoted by a reference numeral 5*c*.

This fixing hole 7*c*, as shown in FIG. 5 and FIG. 6 in particular, is provided in each of the corner portions 7*d* and one of the flat plate portions 7*b* of the sleeve 7, but the present invention is not limited to these positions. Accordingly, in the present application, the respective corner portions 7*d* and the flat plate portions 7*d* are also called a peripheral wall altogether. Further, the number of the fixing holes 7*e* is not limited in particular, but there is a need to provide the fixing holes 7*c* plurally. In the case when the fixing hole 7*c* is provided in the flat plate portion 7*b*, it may be possible to omit providing the fixing hole in one or two of the corner portions 7*d* adjacent to the flat plate portion 7*b*.

Figure 7:
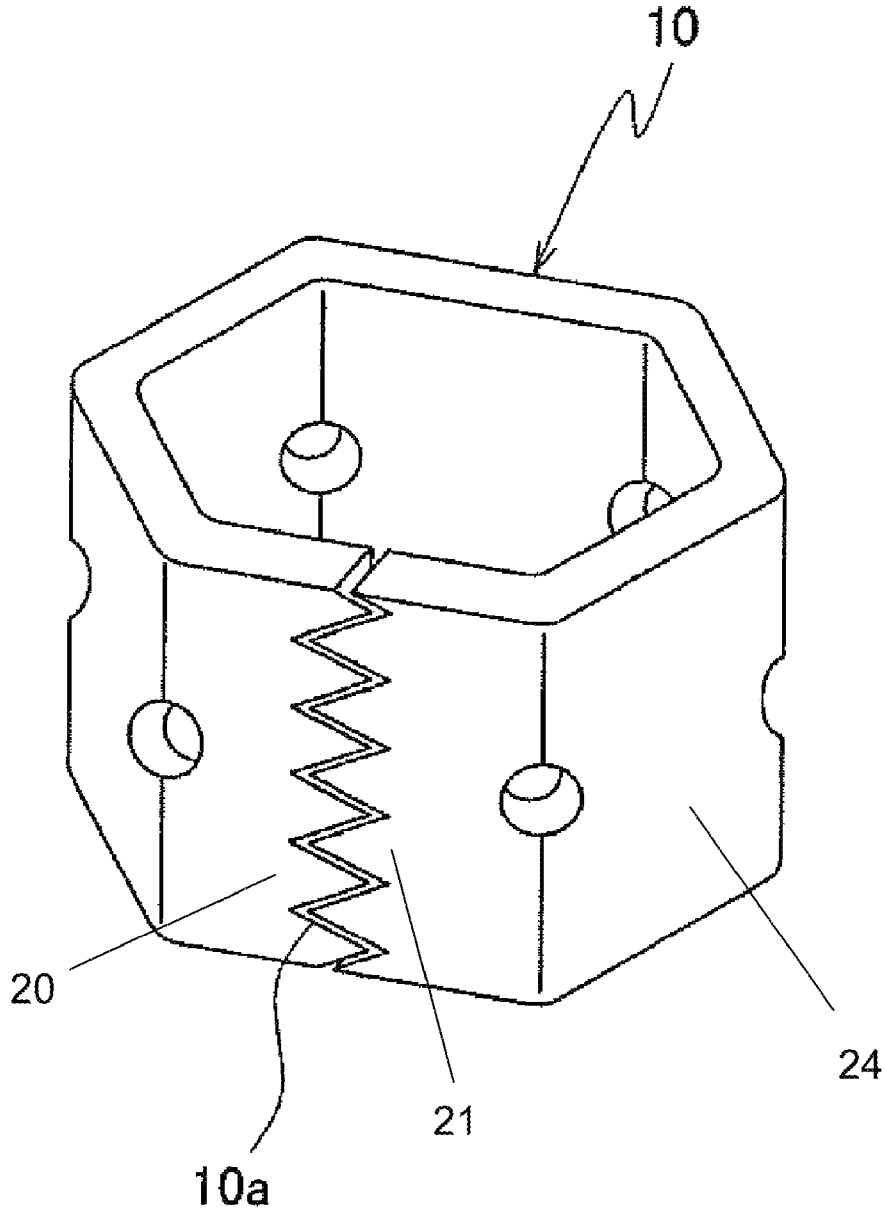
FIG. 7 is a perspective view showing another embodiment of the sleeve in the wheel nut wrench according to the present invention.

FIG. 7 shows another embodiment of the sleeve. According to the drawing, a sleeve 10 according to this embodiment is constituted in a manner that a formation of a joint 10*a* is a jagged pattern.

Figure 8:
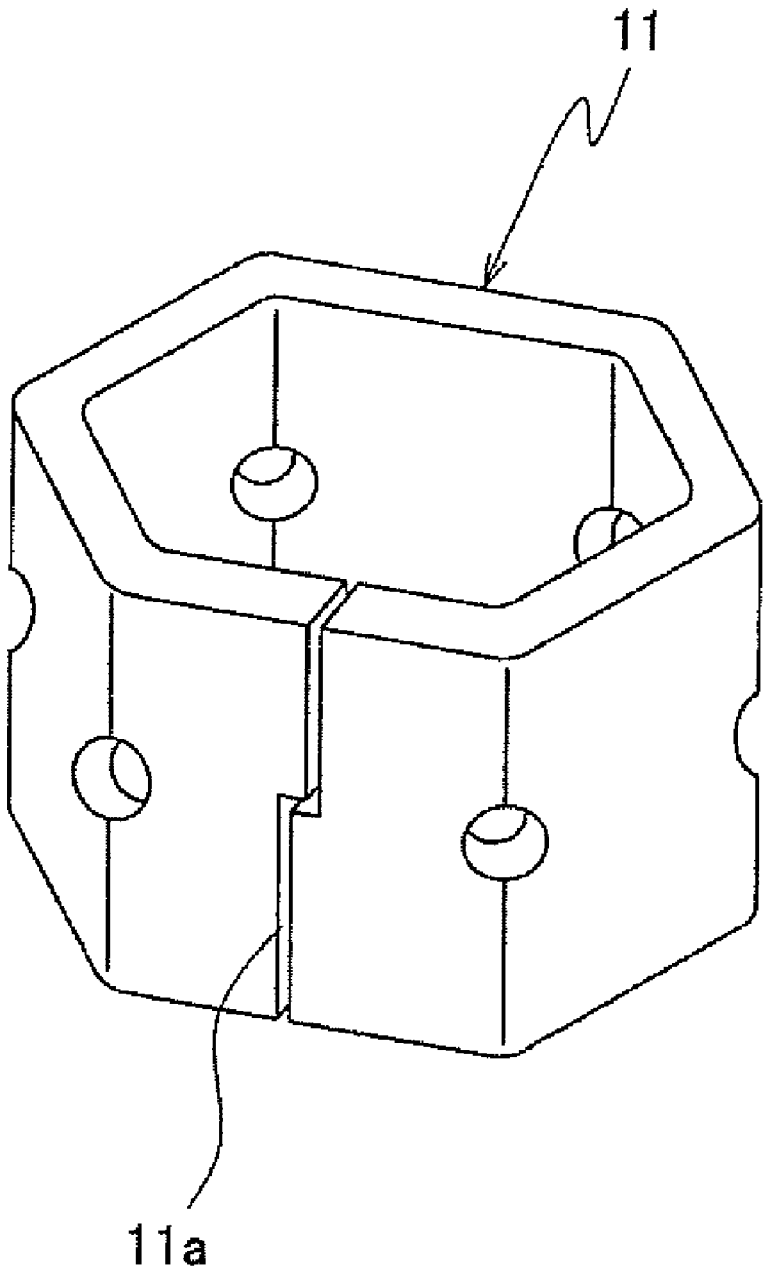
FIG. 8 is a perspective view showing another embodiment of the sleeve in the wheel nut wrench according to the present invention.

This embodiment constituted in this manner makes it possible to effectively prevent the sleeve 10 from twisting toward an axis direction even when a strong torque is exerted on the nut socket portion of the wheel nut wrench in loosening or tightening a wheel nut. The jagged pattern of the joint 10*a* of this sleeve 10 may be zigzag, or as is a sleeve 11 shown in FIG. 8, it may be constituted to have a joint 11*a* having a crank shape.

Figure 9:
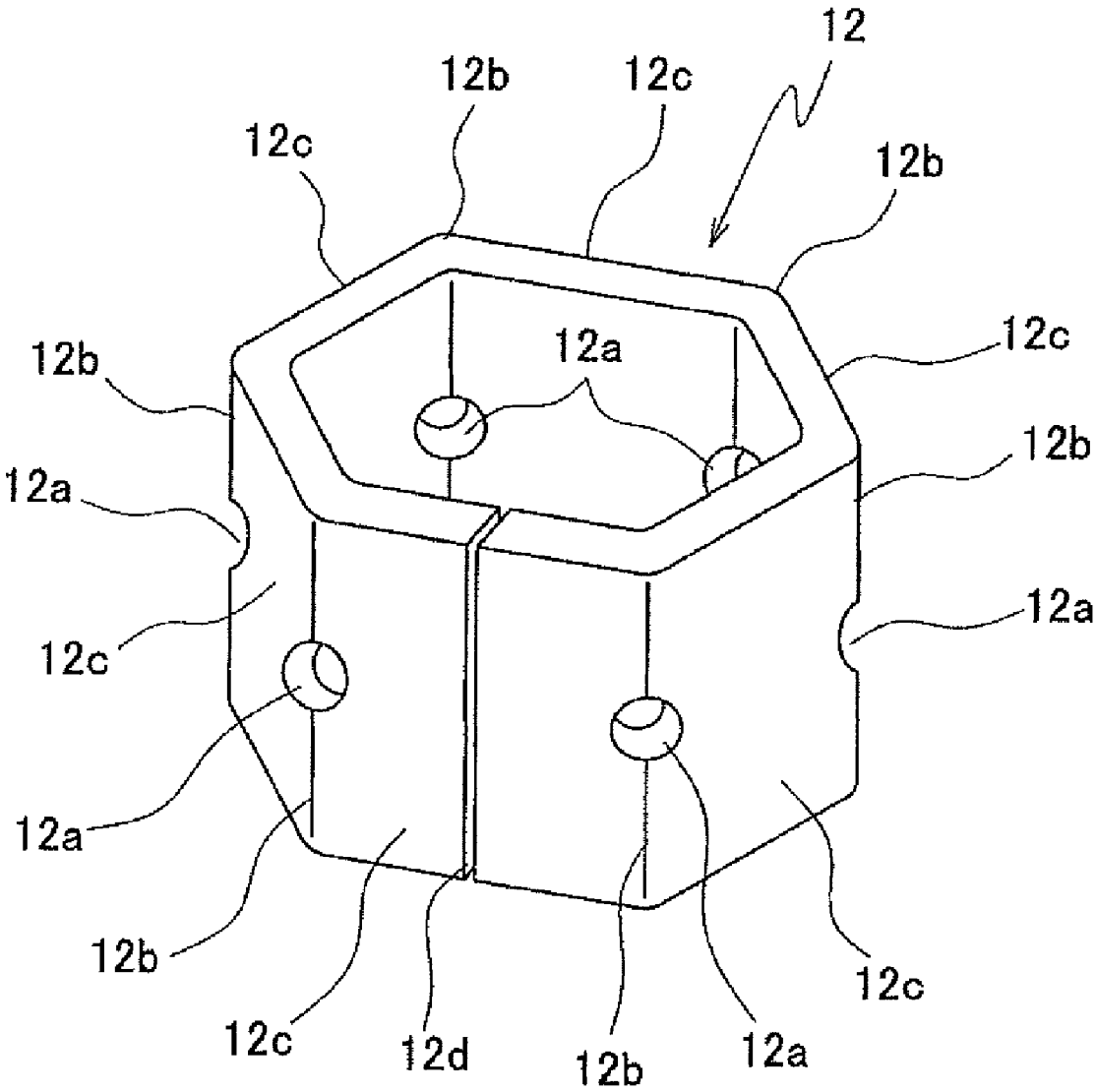
FIG. 9 is a perspective view showing another embodiment of the sleeve in the wheel nut wrench according to the present invention.

FIG. 9 shows still another embodiment of the sleeve. According to the drawing, fixing holes 12*a* provided in a sleeve 12 are all provided in corner portions 12*b*.

Even when this embodiment is constituted in this manner, an object of the present invention can be achieved, and this embodiment has an advantage that it is possible to prevent that by punching, flat plate portions 12*c* of the sleeve 12 are distorted inwardly to be deformed. Note that a reference numeral 12*d* denotes a joint.

FIG. 10A to FIG. 10D through FIG. 12A to FIG. 12D show one embodiment of a manufacturing process of a wheel nut wrench according to the present invention.

Figure 10D:
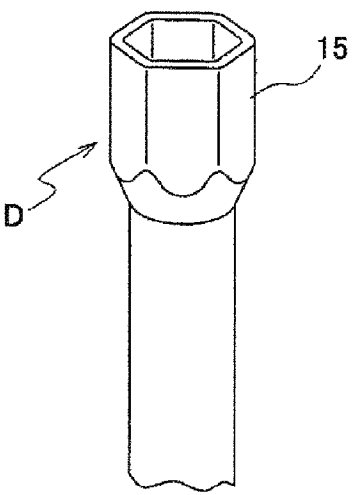
FIG. 10A to FIG. 10D are explanatory views showing a manufacturing process of a wheel nut wrench according to the present invention.
Figure 10C:
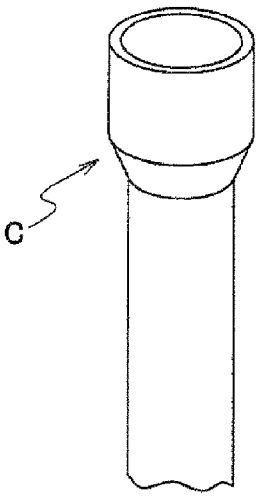
Figure 10B:
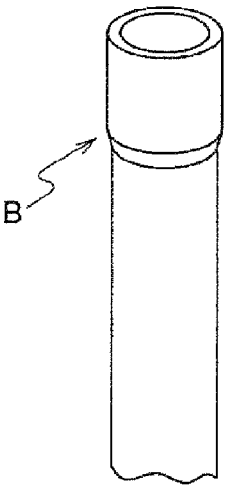
Figure 10A:
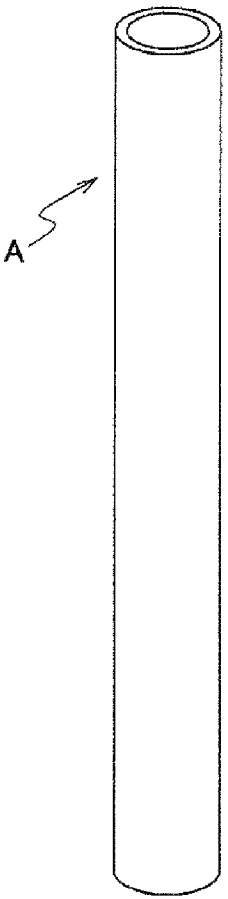
Figure 11:
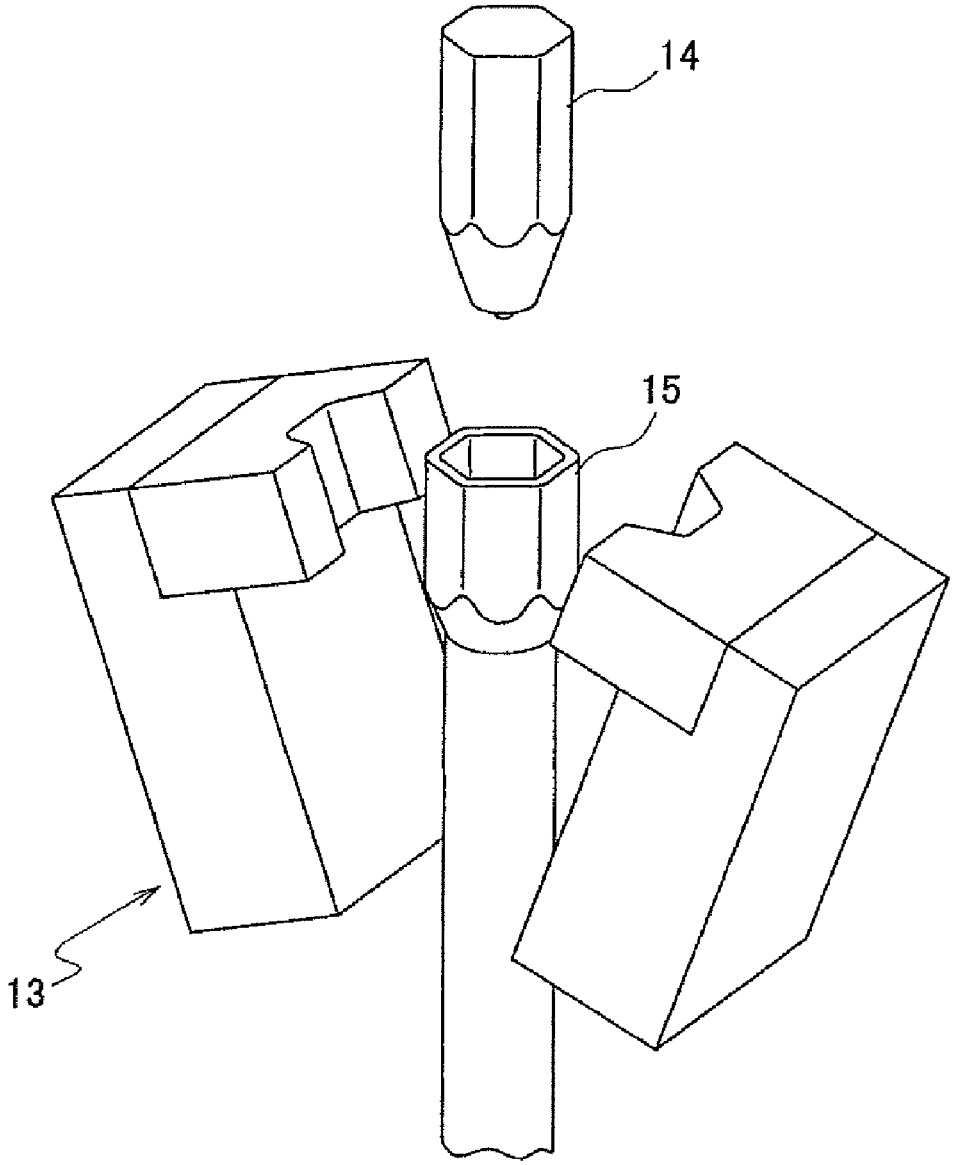
FIG. 11 is an explanatory view showing a forming process of a nut socket shell portion in the wheel nut wrench according to the present invention.

First, as shown in FIG. 10A, a carbon steel tube having a tube diameter of 19 m/m and a thickness of 2 m/m is cut in an appropriate length to be formed as a blank tube A, and deburring or the like is performed. Next, a side where the nut socket portion is provided, being one end portion of the blank tube A, is placed in a beveling die in a press machine, which is not shown, and by using a not-shown punch bar, as shown in FIG. 10B, a first tube expansion is performed to obtain a first processed product B. Next, as for the first processed product B made after this first tube expansion is performed, a portion of the first processed product B, where the tube expansion is performed, is placed in another beveling die that is not shown and whose inside diameter is further expanded, and by using a not-shown punch bar whose diameter is larger than that of the punch bar used in the first tube expansion, a second tube expansion is performed as shown in FIG. 10C to obtain a second processed product C. Next, a portion of this second processed product C, where the tube expansion is performed, as shown in FIG. 11, is placed in a beveling die 13 provided with a hexagonal shaped hole in a plane, and by using a punch bar 14 having a cross section of a hexagonal shape similarly, as shown in FIG. 10D, the portion is formed in a hexagonal shape in a plane to obtain a third processed product D having a nut socket shell portion 15. At this time, a thickness of the portion where the nut socket shell portion 15 in a hexagonal shape in a plane is formed is uniform as shown in FIG. 5 and FIG. 6, but it is possible to make the thickness of the portion thicker or thinner than those of other portions of the blank tube depending on the way how the nut socket shell portion 15 is formed. When the thickness is made thick, strength thereof is increased, and this portion is correlative to strength of a later-described sleeve. The formation of the nut socket shell portion 15 in the blank tube A as above is performed by cold pressing. Note that the tube diameter and thickness of the blank tube A are not limited to the above.

Figures 12A, 12B, 12C, 12D:
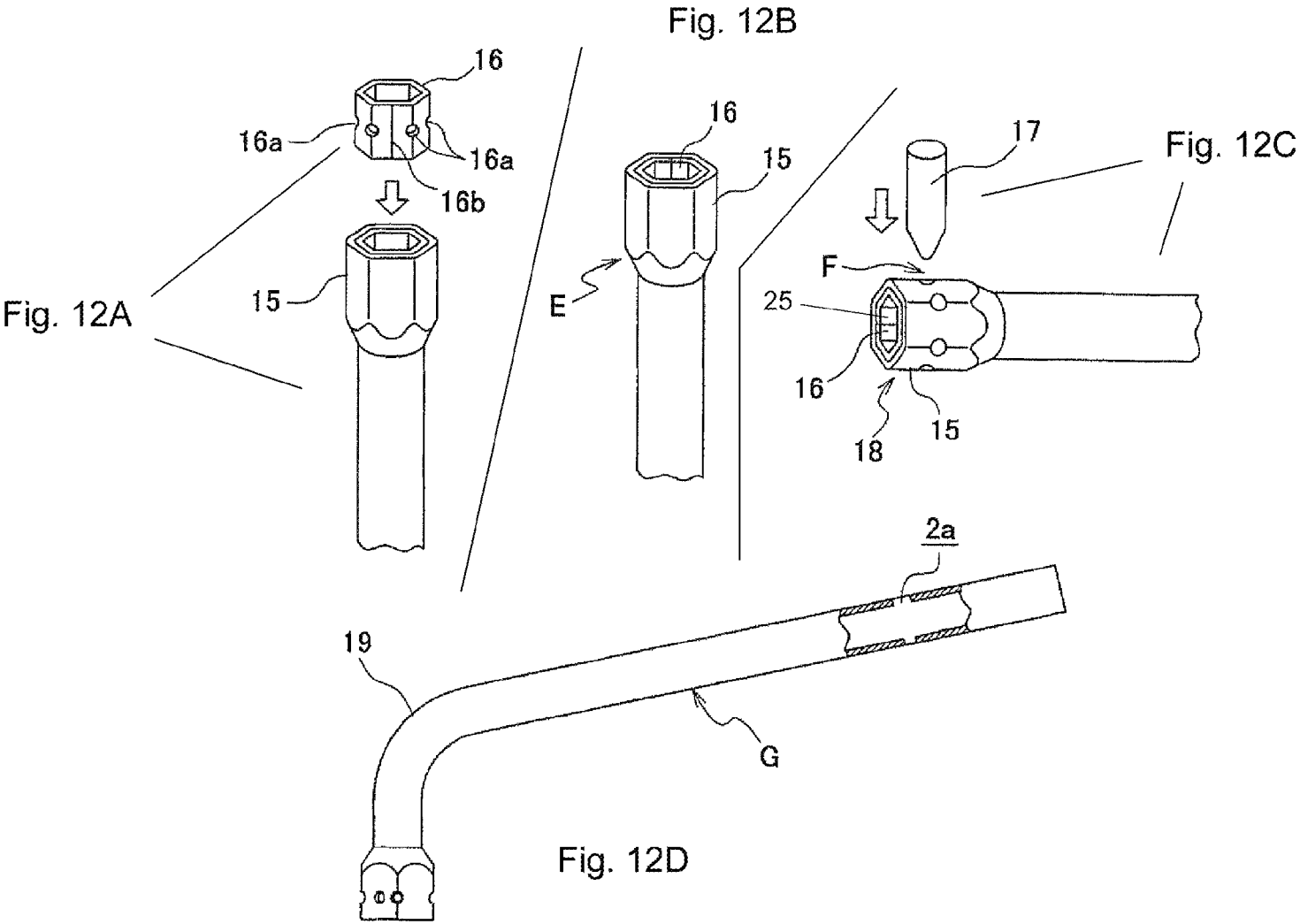
FIG. 12A to FIG. 12*d* are explanatory views to explain the manufacturing process of the wheel nut wrench according to the present invention.

When the nut socket shell portion 15 in a hexagonal shape in a plane cross section is formed at the one end portion of the blank tube A by tube expansion according to the above manner, as shown in FIG. 12A, the step of pressing a sleeve 16 in a hexagonal shape in a plane that is formed at other steps into the nut socket shell portion 15 is started. Here, formation of the sleeve 16 is explained. The sleeve 16 is formed in a manner that a coiled carbon steel plate made of, for example, S45C and having a thickness of 2 mm and a width of 20 mm is used, and the carbon steel plate is cut while fixing holes 16*a* are being punched through by a not-shown progressive press machine and the carbon steel plate is being bent to a hexagonal shape in a plane (this hexagonal shape is adjusted to a shape of an outside diameter of a wheel nut). At this time, a joint 16*b* is made, but it is preferable that this joint 16*b* is provided with a slight opening, (which is about 0.1 to 0.5 mm). The thickness of the sleeve 16 is 2 mm in accordance with the thickness of the blank tube, but this thickness is not limited.

Further, the opening in the joint 16*b* is an opening that is eliminated because the entire sleeve 16 shrinks when the sleeve 16 is pressed into the nut socket shell portion 15. A shape of the joint 16*b* is straight in this embodiment, but it is arbitrary that the shape thereof is set as a zigzag shape, a clank shape, or the like. When a zigzag shape is applied, there is an effect that it is possible to prevent that the sleeve 16 is twisted by torsional pressure, thereby a position of the sleeve 16 being displaced in an up and down direction when a wheel nut is tightened or loosened. The joint 16*b* is preferably in a flat plate portion 24 of the sleeve 16, but it is also possible to bring the joint 16*b* to a comer portion. Further, although an increase in cost is caused a little, it is also possible to weld the joint 16*b*. As for welding, continuous welding, spot welding, or the like is available.

The steps until the sleeve 16 in a hexagonal shape in a plane is formed are a cold press process, and it is preferable that a heat treatment such as quenching and tempering is performed after the sleeve 16 is formed to thereby increase its strength.

As shown in FIG. 12B, after the sleeve 16 is pressed into and fixed to the nut socket shell portion 15 to obtain a fourth processed product E, as shown in FIG. 12A and FIG. 12C, punching is performed to the fixing hole 16*a* of the sleeve 16 from the outside of the nut socket shell portion 15 by using a punch bar 17, and as shown in FIG. 5 in particular, the nut socket shell portion 15 is bulged to each of the fixing holes 16*a* to form a nut socket portion 18, which is set as a fifth processed product F. Next, as shown in FIG. 12D, a handle portion is bent to form a bent portion 19, and a pierced hole 2*a* is provided by a press machine and a plated finish is performed, and then a finished product G having a hexagonal cavity 25 for engaging wheel nuts is made. Note that an angle of the bent portion 19 can be selected arbitrarily.

Figure 13:
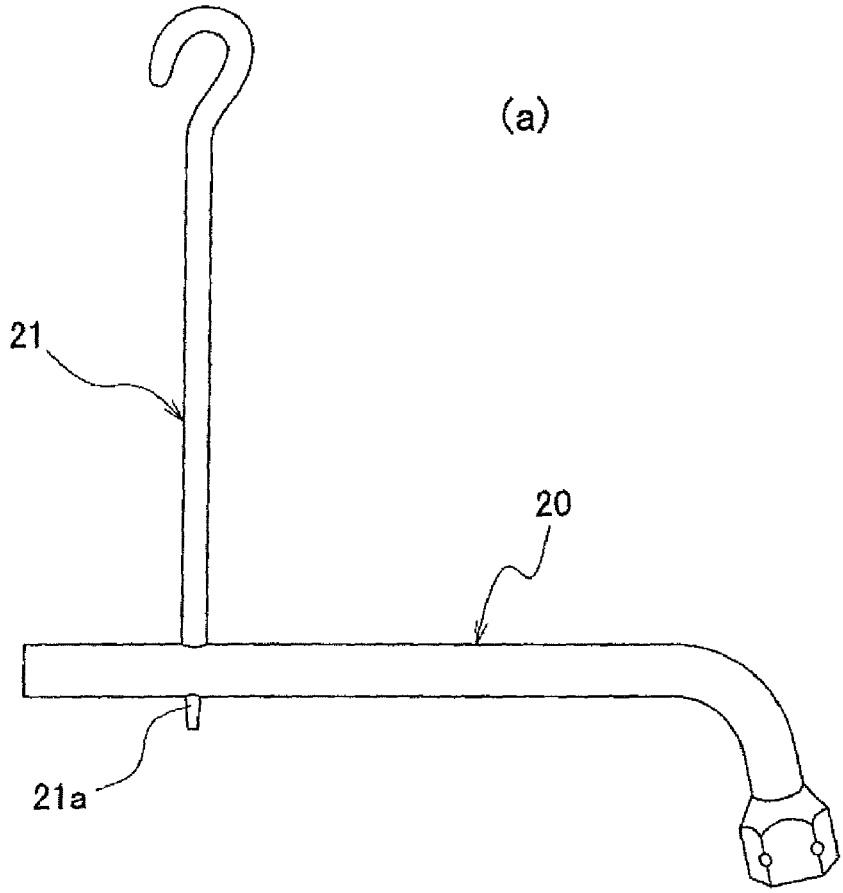
FIG. 13(*a*) and FIG. 13(*b*) show a case when a single-ended L-shaped wheel nut wrench is used as a handle for a rotary shaft of a vehicle jack, and FIG. 13(*a*) is an explanatory view thereof and FIG. 13(*b*) is a partial enlarged cross sectional view of the explanatory view.
Figure 13:
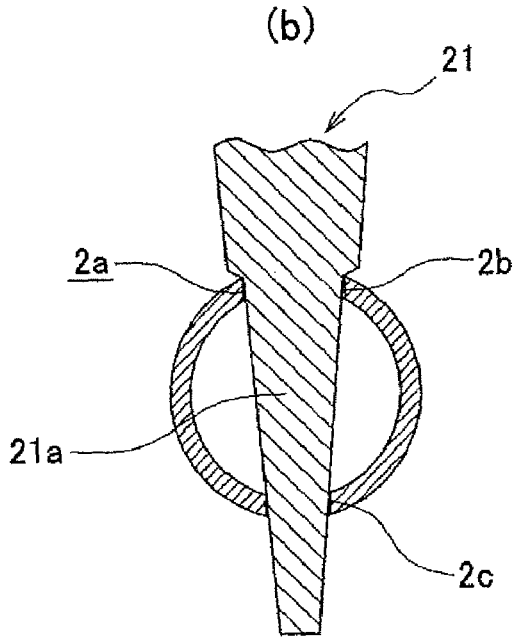

Further, an order in which the pierced hole 2*a* is provided is not limited. It is arbitrary that the pierced hole 2*a* is not provided at a later step of the manufacturing process as described above but it is provided at a different and earlier process. This pierced hole 2*a*, as shown in FIG. 13(*a*) and FIG. 13(*b*), is to be used when a single-ended L-shaped wheel nut wrench 20 is used as a rotary handle to a rotary shaft 21 of a vehicle jack. As shown in FIG. 13(*b*) in particular, when a size of the pierced hole 2*a* is changed by making an entry 2*b* of this pierced hole 2*a* large and making an exit 2*c* thereof small, in the case when a tip 21*a* of the rotary shaft 21 is tapered, there is an advantage that the tapered tip can be fit into the pierced hole 2*a* without any trouble because a handle portion 2 is tube shaped and a predetermined interval is provided between the entry 2*b* and the exit 2*c*. However, a shape of the pierced hole 2*a* is according to a shape of the rotary shaft 21 to be inserted, and it is not limited to the above in this embodiment.

Note that in the above explanation, the case when the present invention is applied to the single-ended L-shaped wheel nut wrench is explained, but as described above, it goes without saying that the present invention can also be applied to an open-ended type wheel nut wrench and a single-ended T-shaped wheel nut wrench besides the above.

The present invention is constituted as above, and thus it is tube shaped and strong against torsional deformation, and can be manufactured inexpensively. Accordingly, the present invention has a possibility to be widely used as a wheel nut wrench for vehicles in particular.

What is claimed is:

1. A wheel nut wrench made with a tube-shaped steel tube and provided with a nut socket portion at least one end, the wrench comprising:

a nut socket shell portion having an inner periphery and an outer periphery, the inner and outer peripheries both being formed in a hexagonal shape and comprising corner portions, the nut socket shell being provided at an end portion of the steel tube;

a sleeve comprising a bent steel plate having a hexagonal cross section, the sleeve comprising a plurality of corner portions and a plurality of flat plate portions, the sleeve also comprising a joint portion where opposite ends of the bent steel plate are close to or engaged with each other, the sleeve being pressed into the nut socket shell portion;

wherein the sleeve further comprises one or more fixing holes provided at each of the corner portions;

wherein the nut socket shell portion comprises a plurality of fixing protuberances protruding from the inner periphery, and wherein each fixing protuberance bulges into one of the fixing holes of the sleeve; and wherein the fixing protuberances secure the sleeve inside the nut socket shell portion by engagement with the fixing holes.

2. A wheel nut wrench according to claim 1, wherein the sleeve is made by a process comprising the steps of providing an elongated steel plate, forming fixing holes, and bending the elongated steel plate to have the hexagonal cross section;

wherein the fixing holes are formed before the sleeve is pressed into the nut socket portion; and wherein the fixing holes have edges which do not project substantially above or below a plane of the steel plate or the resulting hexagonal sleeve.

3. A wheel nut wrench according to claim 2, wherein the opposite ends of the steel plate of the sleeve each comprise one or more protrusions;

wherein the protrusions of the opposite ends of the plate abut each other at the joint portion of the sleeve; and wherein the protrusions are interlocking and are adapted to block movement of the ends of the steel plate relative to each other in at least one direction.

4. A wheel nut wrench according to claim 1, wherein the hexagonal sleeve defines six sides of a hexagonal cavity adapted for receiving objects to be rotated by the wheel nut wrench;

wherein the fixing protuberances comprise convex bumps and do not include holes or pierced surfaces; and wherein neither the edges of the fixing holes of the sleeve, nor the fixing protuberances, protrude into the hexagonal cavity.

5. A wheel nut wrench according to claim 1, wherein the sleeve has a uniform thickness, and wherein the joint portion of the sleeve is welded closed.

6. The wheel nut wrench according to claim 1, wherein a pierced hole having a size different at an entry thereof and an exit thereof is provided in a handle portion in a direction perpendicular to the handle portion.

7. The wheel nut wrench according to claim 1, wherein the wheel nut wrench has an L shape and only comprises a single nut socket portion.

8. A wheel nut wrench made with a tube-shaped steel tube and provided with a nut socket portion at least one end, the wrench comprising:

a nut socket shell portion having an inner periphery and an outer periphery, the inner and outer peripheries both being formed in a hexagonal shape and comprising corner portions, the nut socket shell being provided at an end portion of the steel tube;

a sleeve comprising a bent steel plate having a hexagonal cross section, the sleeve comprising a plurality of corner portions and a plurality of flat plate portions, one of the flat plate portions having a joint portion where opposite ends of the bent steel plate are close to or engaged with each other, the sleeve being pressed into the nut socket shell portion;

wherein the sleeve further comprises a plurality of fixing holes provided at respective corner portions of the sleeve;

the joint portion of the sleeve also includes a fixing hole;

the nut socket shell portion comprises a plurality of fixing protuberances protruding from the inner periphery, wherein each fixing protuberance bulges into one of the fixing holes of the sleeve; and wherein the fixing protuberances secure the sleeve inside the nut socket shell portion by engagement with the fixing holes.

9. A wheel nut wrench according to claim 8, wherein the sleeve is made by a process comprising the steps of providing an elongated steel plate, forming fixing holes, and bending the elongated steel plate to have the hexagonal cross-section;

wherein the fixing holes are formed before the sleeve is pressed into the nut socket portion; and wherein the fixing holes have edges which do not project substantially above or below a plane of the steel plate or the resulting hexagonal sleeve.

10. A wheel nut wrench according to claim 9, wherein the opposite ends of the steel plate of the sleeve each comprise one or more protrusions;

wherein the protrusions of the opposite ends of the plate abut each other at the joint portion of the sleeve; and wherein the protrusions are interlocking and are adapted to block movement of the ends of the steel plate relative to each other in at least one direction.

11. A wheel nut wrench according to claim 8, wherein the sleeve has a uniform thickness, and wherein the joint portion of the sleeve is welded closed.

12. The wheel nut wrench according to claim 8, wherein a pierced hole having a size different at an entry thereof and an exit thereof is provided in a handle portion in a direction perpendicular to the handle portion.

13. The wheel nut wrench according to claim 8, wherein the wheel nut wrench has an L shape and only comprises a single nut socket portion.

14. A wheel nut wrench according to claim 8, wherein the sleeve comprises six corner portions, each corner portion comprising a fixing hole;

wherein the wheel nut wrench comprises a hexagonal cavity adapted for engaging objects to be rotated by the wheel nut wrench;

the nut socket shell portion comprises fixing protuberances bulging into each of the fixing holes at the corner portions of the sleeve; and the fixing protuberances consist of convex bumps which do not include holes or pierced surfaces, and which do not protrude into the hexagonal cavity.

* * * * *